US008538296B2

(12) United States Patent
Ogasawara et al.

(10) Patent No.: US 8,538,296 B2
(45) Date of Patent: Sep. 17, 2013

(54) IMAGE FORMING APPARATUS WITH REDUCED LEAKAGE FROM A CHARGING DEVICE

(75) Inventors: Masato Ogasawara, Tokyo (JP); Hisashi Nakai, Kanagawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 346 days.

(21) Appl. No.: 13/019,672

(22) Filed: Feb. 2, 2011

(65) Prior Publication Data

US 2011/0188892 A1 Aug. 4, 2011

Related U.S. Application Data

(60) Provisional application No. 61/300,864, filed on Feb. 3, 2010.

(51) Int. Cl.
*G03G 15/02* (2006.01)

(52) U.S. Cl.
USPC ..... 399/171; 399/172

(58) Field of Classification Search
USPC ..... 399/170–173
See application file for complete search history.

(56) References Cited

FOREIGN PATENT DOCUMENTS

JP P3290799 6/2002

*Primary Examiner* — William J Royer
(74) *Attorney, Agent, or Firm* — Turocy & Watson, LLP

(57) ABSTRACT

An image forming apparatus includes an image carrier whose surface is moved in a specific direction, a charging device to charge the image carrier, an exposure device to form an electrostatic latent image by exposing a surface of the charged image carrier in accordance with an image signal, a developing device to supply a developer to the surface of the image carrier on which the electrostatic latent image is formed, a transfer device to transfer a developer image formed on the surface of the image carrier onto an image forming medium, and a dielectric member that has a dielectric constant of 5 or less and is disposed near the image carrier and between the charging device and the exposure device, in which the charging device, the exposure device, the developing device and the transfer device are sequentially arranged around the image carrier along the movement direction of the surface of the image carrier.

19 Claims, 5 Drawing Sheets

IMAGE FORMING APPARATUS WITH REDUCED LEAKAGE FROM A CHARGING DEVICE

CROSS-REFERENCE TO RELATED APPLICATION

This application is based upon and claims the benefit of priority from provisional U.S. patent application Ser. No. 61/300,864 filed on Feb. 3, 2010, the entire contents of which are incorporated herein by reference.

FIELD

The present invention relates to an electrophotographic image forming apparatus, and particularly to a technique to prevent electrification charge from leaking from a charging unit to an exposure part.

BACKGROUND

In an electrophotographic image forming apparatus such as a printer or a copying machine, a uniformly charged image carrier is exposed, a developer (toner) is attached to a part (latent image) in which the potential is changed, and a toner image is transferred to a transfer target body, so that a desired image is obtained. After the transfer, transfer residual toner and electric charge on the image carrier are removed, and preparation is made for next image formation.

As stated above, the process of image formation requires many processes such as charging, exposure, development, transfer, cleaning and charge removal, and devices for them are respectively disposed around the image carrier.

In recent years, in the image forming apparatus as stated above, miniaturization thereof is required, and especially in a full-color printer or copying machine adopting a four-tandem system, further miniaturization is required from the viewpoint of installation on a table and space saving.

However, when the image forming apparatus is miniaturized, there is a problem that an interval between a charging device and an exposure device becomes short, and electrification charge discharged from the charging device leaks to the exposure device and disturbs a latent image, which becomes a cause to prevent the miniaturization of the image forming apparatus.

BRIEF DESCRIPTION OF THE DRAWINGS

The accompanying drawings, which are incorporated in and constitute a part of this specification, illustrate an embodiment of the invention and together with the description, serve to explain the principles of the invention.

DETAILED DESCRIPTION

Figure 1:
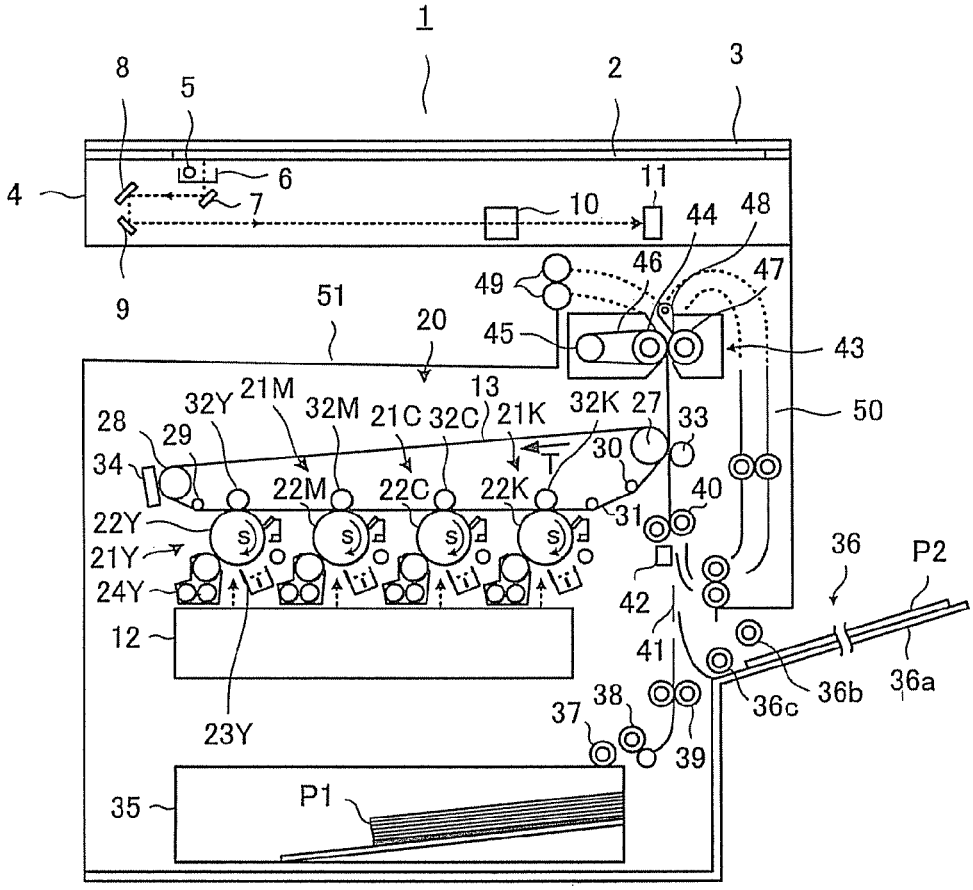
FIG. 1 is a schematic view showing the whole structure of an image forming apparatus of an embodiment.

Reference will now be made in detail to the present embodiment of the invention, an example of which is illustrated in the accompanying drawing.

According to an aspect, an image forming apparatus includes, at least, an image carrier whose surface is moved in a specific direction, a charging device to charge the image carrier, an exposure device to form an electrostatic latent image by exposing a surface of the charged image carrier in accordance with an image signal, a developing device to supply a developer to the surface of the image carrier on which the electrostatic latent image is formed, a transfer device to transfer a developer image formed on the surface of the image carrier onto an image forming medium, and a dielectric member that has a dielectric constant of 5 or less and is disposed near the image carrier and between the charging device and a photoreceptor surface part exposed by the exposure device, in which the charging device, the exposure device, the developing device and the transfer device are sequentially arranged around the image carrier along the movement direction of the surface of the image carrier.

Besides, according to another aspect, it is preferable that the charging device includes a charge generation part to perform corona discharge, a conductive housing that covers the charge generation part and is made of a metal or the like having an opening for discharge, and a grid electrode attached to the opening, the dielectric member is fixed to a side surface of the housing at a side of the exposure device, and a tip part thereof is fixed to protrude to a side of the image carrier from the grid electrode.

When the image forming apparatus is miniaturized, as a method of preventing electrification charge from leaking from the charging device to the exposure device on the image carrier, a method is conceivable in which a shielding member is brought into contact with the image carrier, and physical shielding is performed. However, in this case, for example, there occurs a defect that the surface of the image carrier is scraped and a streak in a sheet paper conveyance direction appears in the image, a defect that an abnormal potential is given to the image carrier by friction charging, or a defect that a toner additive slipping through a cleaning blade stays in the shielding member and pollutes the inside of the charging device.

On the other hand, when the shielding member is made long and the pressure of contacting with the image carrier is reduced, there occurs a defect that the shielding member enters the exposure position, and normal image formation can not be performed.

Besides, as a defect when the shielding member is brought into contact with the image carrier, the inside of the charging device is filled with an ozone product generated by the electrification charge, and after the end of printing, the ozone product generated by the electrification charge is attached to the stopped image carrier, and a defective image occurs.

Regarding these, as a result of keen examination by the inventors, it is found that when the shielding member placed between the charging device and the exposure position on the image carrier is controlled, even if the interval between the charging device and the exposure position becomes short, the deterioration of the image carrier by ozone and the leakage of the electrification charge to the exposure position can be prevented. That is, it is found that when the dielectric constant of the shielding member is 5.0 or less and the gap (distance) between the image carrier and the shielding member is kept to a specific width, the deterioration of the image carrier by the ozone and the leakage of the electrification charge to the exposure position can be prevented.

Hereinafter, an embodiment will be described with reference to the drawings. Incidentally, the same reference numeral in the follow description designates the same structure and function.

FIG. 1 is a schematic view showing an example of the whole structure of an image forming apparatus 1 of the embodiment. As shown in FIG. 1, a document table 2 for placing a document, which is formed of a transparent material such as a glass plate, is provided at an upper part of the image forming apparatus 1. Besides, a cover 3 is openably and closably provided so as to cover the document table 2.

A scan part 4 to optically read an image of a document placed on the document table 2 is provided at a lower surface side of the document table 2. The scan part 4 includes, for example, a carriage 6 having a light source 5 to irradiate light to the document table 2, reflecting mirrors 7, 8 and 9 to reflect the light of the light source 5 reflected by the document, a variable power lens block 10 to magnify the reflected light, and a CCD (Charge Coupled Device) 11. The carriage 6 is provided to be capable of reciprocating along the lower surface of the document table 2.

The carriage 6 moves while the light source 5 is lit, so that the document placed on the document table 2 is exposed. The reflected light image of the document by this exposure is projected onto the CCD 11 through the reflecting mirrors 7, 8 and 9 and the variable power lens block 10. The CCD 11 outputs an image signal corresponding to the projected reflected light image of the document. The image signal outputted from the CCD 11 is suitably processed, and is then supplied to an exposure device (latent image forming device) 12.

An image forming part 20 to execute an image forming process in which an image is formed based on the image signal outputted from the CCD 11 and the image is printed on a sheet paper (recording medium P1 or P2) is provided below the scan part 4.

The image forming part 20 includes four sets of process units 21Y, 21M, 21C and 21K of yellow (Y), magenta (M), cyan (C) and black (K) arranged in parallel along the lower side of an intermediate transfer belt 13. The process units 21Y, 21M, 21C and 21K will be described later with reference to FIGS. 2 and 3.

The intermediate transfer belt 13 is stretched by a backup roller 27, a driven roller 28 and first to third tension rollers 29, 30 and 31. The intermediate transfer belt 13 faces and contacts with photoconductive drums (image carriers) 22Y, 22M, 22C and 22K.

Primary transfer rollers 32Y, 32M, 32C and 32K for primarily transferring toner images on the photoconductive drums 22Y, 22M, 22C and 22K to the intermediate transfer belt 13 are provided as primary transfer parts at positions where the intermediate transfer belt 13 faces the photoconductive drums 22Y, 22M, 22C and 22K. The primary transfer rollers 32Y, 32M, 32C and 32K are respectively conductive drums, and primary transfer bias voltages are applied to the respective primary transfer parts.

A secondary transfer roller 33 is disposed as a secondary transfer part at a position where the intermediate transfer belt 13 is supported by the backup roller 27. In the secondary transfer part, the backup roller 27 is a conductive roller, and a specified secondary transfer bias is applied. When the sheet paper P1 or P2 passes through between the intermediate transfer belt 13 and the secondary transfer roller 33, the toner image on the intermediate transfer belt 13 is secondarily transferred onto the sheet paper P1 or P2. After the secondary transfer is ended, toner remaining on the intermediate transfer belt 13 is cleaned by a belt cleaner 34.

A paper feed cassette 35 to supply the sheet paper P1 in the direction of the secondary transfer roller 33 is provided below the exposure device 12. A manual feed mechanism 36 to manually feed the sheet paper P1 or P2 is provided at the right side of the image forming apparatus 1.

A pickup roller 37, a separation roller 38, a conveyance roller 39 and a register roller pair 40 are provided between the paper feed cassette 35 and the secondary transfer roller 33. Besides, a manual pickup roller 36*b* and a manual separation roller 36*c* are provided between a manual feed tray 36*a* of the manual feed mechanism 36 and the register roller pair 40, and these constitute a paper feed mechanism.

Further, a media sensor 42 to detect the kind of the sheet paper P1 or P2 is arranged on a vertical conveyance path 41 to convey the sheet paper P1 or P2 in the direction of the secondary transfer roller 33 from the paper feed cassette 35 or the manual feed tray 36*a*. The image forming apparatus 1 can control the conveyance speed of the sheet paper P1 or P2, the transfer condition, the fixing condition and the like from the detection result obtained by the media sensor 42. Besides, a fixing device 43 is provided downstream of the secondary transfer part along the direction of the vertical conveyance path 41.

The sheet paper P1 or P2 taken out from the paper feed cassette 35 or fed from the manual feed mechanism 36 is conveyed to the fixing device 43 through the register roller pair 40 and the secondary transfer roller 33 along the vertical conveyance path 41.

The fixing device 43 includes a fixing belt 46 wound around a pair of a heating roller 44 and a driving roller 45, and an opposite roller 47 arranged to be opposite to the heating roller 44 through the fixing belt 46. The sheet paper P1 or P2 having the toner image transferred by the secondary transfer part is introduced between the fixing belt 46 and the opposite roller 47, and is heated by the heating roller 44, so that the toner image transferred on the sheet paper P1 or P2 is fixed.

A gate 48 is provided downstream of the fixing device 43, and the sheet paper P1 or P2 is distributed in the direction of a paper discharge roller 49 or the direction of a reconveyance unit 50. The sheet paper P1 or P2 guided to the paper discharge roller 49 is discharged to a paper discharge part 51. Besides, the sheet paper P1 or P2 guided to the reconveyance unit 50 is again guided in the direction of the secondary transfer roller 33.

Figure 2:
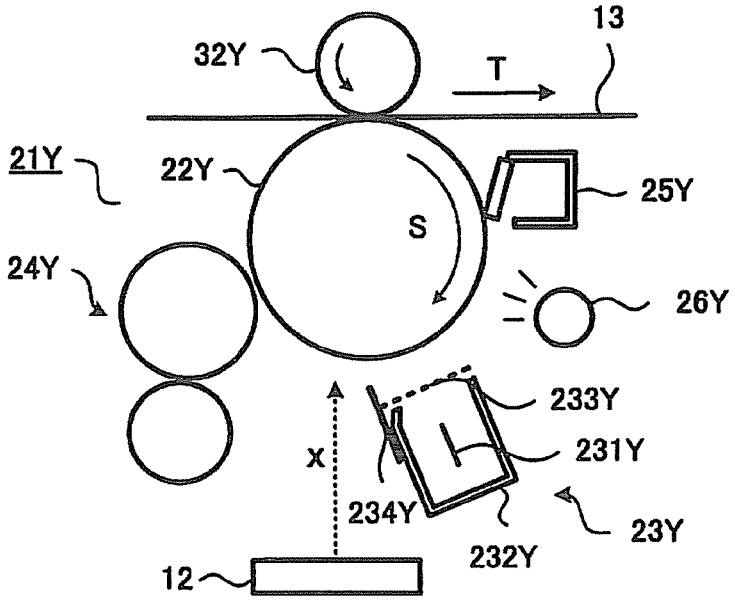
FIG. 2 is a schematic structural view showing a process unit in FIG. 1.
Figure 3:
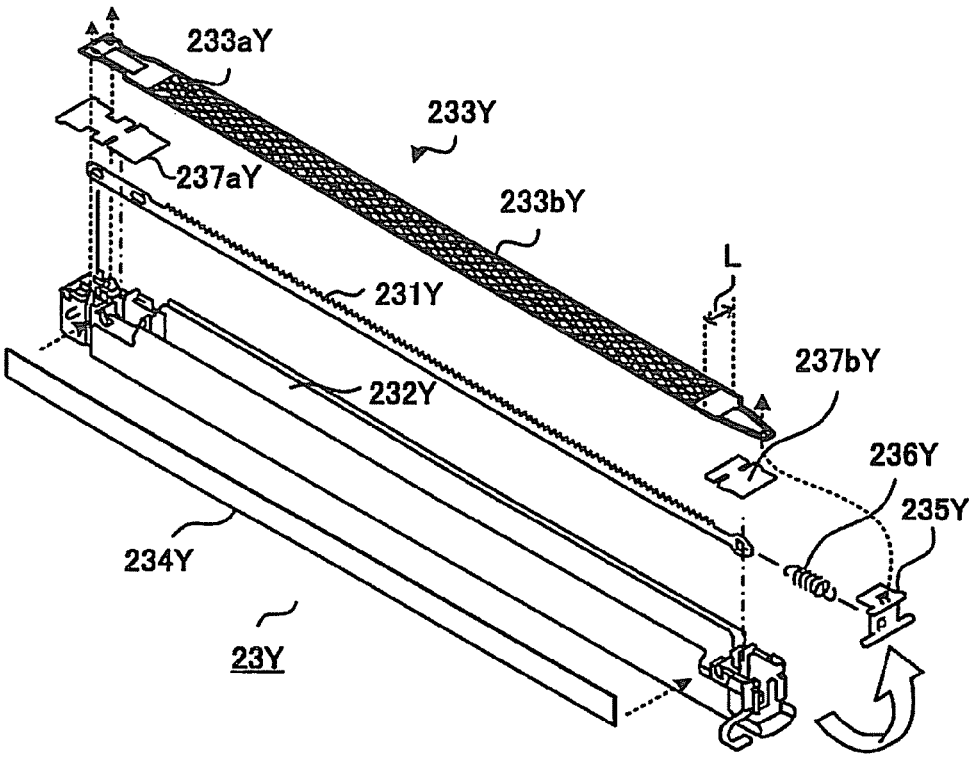
FIG. 3 is a schematic structural view of a charging device in FIG. 2.

FIG. 2 is a view showing a structure of the process unit 21Y in FIG. 1, and FIG. 3 is a perspective view of a charging device 23Y in FIG. 2. Incidentally, since the process units 21M, 21C and 21K have the same structure as the process unit 21Y, their description is omitted.

As shown in FIG. 2, the process unit 21Y includes the photoconductive drum 22Y, the charging device 23Y to charge the photoconductive drum 22Y, the exposure device 12 to form an electrostatic latent image on the photoconductive drum 22Y, a developing unit 24Y including a developing roller to supply a developer to the photoconductive drum 22Y and to develop, a photoconductive drum cleaner 25Y to remove and collect the transfer residual toner, and a charge removing unit 26Y to remove the electrostatic latent image after development and transfer.

The photoconductive drum 22Y rotates in an arrow S direction, and from the upstream side of the photoconductive drum 22Y, the charging device 23Y to uniformly charge the photoconductive drum 22Y, the developing unit 24Y to form a toner image based on the electrostatic latent image obtained by the exposure device 12, the photoconductive drum cleaner 25Y to remove the toner (transfer remaining toner) remaining on the image carrier after the toner image transfer, and the charge removing unit 26Y to remove the electric charge on the photoconductive drum 22Y are arranged in this order.

The photoconductive drum 22Y is scanned and exposed (an arrow X) with a laser beam corresponding to the image signal of yellow color (Y) by the exposure device 12 between the charging device 23Y and the developing unit 24Y, and an electrostatic latent image is formed on the photoconductive drum 22Y.

The developing unit 24Y includes a two-component developer including a yellow toner and a carrier, and supplies the toner to the electrostatic latent image on the photoconductive drum 22Y. The photoconductive drum cleaner 25Y includes a drum cleaning blade which contacts with the surface of the photoconductive drum 22Y, and scrapes the toner remaining on the photoconductive drum 22Y by the drum cleaning blade. The charge removing unit 26Y removes the electric charge remaining on the surface of the photoconductive drum 22Y.

FIG. 3 is an explosive perspective view showing a schematic structure of the charging device 23Y. As shown in FIG. 3, the charging device 23Y includes a charge generating part 231Y to generate corona discharge, a housing 232Y to surround the charge generating part 231Y, a grid electrode 233Y to control the amount of corona discharge, and a shielding member 234Y.

The charge generating part 231Y is for performing the corona discharge, and a needle-shaped (sawtooth) or a wire electrode made of, for example, stainless steel is used. Particularly, the needle-shaped (sawtooth) electrode shown in FIG. 3 is preferable since it has directionality and can concentrically discharge electricity to the photoreceptor side. The charge generating part 231Y is attached to an arm 235Y, which is attached to an end part of the housing 232Y, through an elastic body 236Y such as a spring. Terminal covers 237*a*Y and 237*b*Y are attached to both end parts of the charge generating part 231Y. The charge generating part 231Y is disposed in parallel to the axial line of the photoconductive drum 22Y.

A metal such as stainless steel is preferably used for the housing 232Y. The housing 232Y may be formed of a conductive resin material (for example, polycarbonate) containing carbon, or may be formed by bonding a conductive tape (for example, aluminum foil tape) to a surface of an insulating resin material as a base opposite to the charge generating part 231Y. When an insulating body is used for the housing 232Y, the electrification charge is directly irradiated to the housing 232Y, and there occurs a defect that the surface potential of the photoreceptor is unstable especially immediately after the start of charging, or static electricity stored in the housing 232Y attracts the scattered toner and the inside of the housing 232Y is polluted, and therefore, the insulating body is not preferable. The cross-sectional shape of the housing 232Y is substantially C-shaped, and the length thereof is substantially equal to or slightly longer than the axial line length of the photoconductive drum 22Y. The housing 232Y covers the charge generating part 231Y and is disposed in parallel to the axial line of the photoconductive drum 22Y.

The charging device 23Y is disposed so that the surface to which the grid electrode 233Y is attached faces the photoconductive drum 22Y. A metal plate of stainless steel or the like having a mesh-shaped opening 233*a*Y is used as the grid electrode 233Y. A peripheral part 233*b*Y is a non-mesh part. The grid electrode 233Y is attached to an opening of the housing 232Y. The shape and size of the grid electrode 233Y are suitably determined according to the shape and size of the opening of the housing 232Y. When the width (FIG. 3; L) of the grid electrode 233Y is made such that the grid electrode 233Y is larger than the opening width of the housing 232Y, there is an effect to prevent the electrification charge from leaking from the gap between the housing 232Y and the grid electrode 233Y. However, only by that, it is impossible to prevent the electrification charge passing through the mesh of the grid electrode 233Y from leaking to the exposure part, and therefore, the shielding member 234Y is required.

A material of the shielding member 234Y is not limited as long as the material is a dielectric member having a dielectric constant of 5.0 or less and can be shaped into a sheet shape, and for example, ABS, denatured PPE, PET, Teflon™, polymethyl acrylate or the like is used. The shielding member 234Y is attached to the side surface of the housing 232Y at the downstream side in the arrow S direction of the photoconductive drum 22Y, that is, to the side surface at the exposure position side of the photoconductive drum 22Y so as to protrude in the direction of the photoconductive drum 22Y.

Besides, it is preferable that the shielding member 234Y is placed to keep a specific gap (distance) from the photoconductive drum 22Y. When the gap between the shielding member 234Y and the photoconductive drum 22Y is too short, an ozone product remains in the charging device 23Y, and is attached onto the photoconductive drum 22Y, so that an image defect is produced. On the other hand, when the gap is too long, the electrification charge leaks to the exposure position.

Hereinafter, the embodiment will be described in more detail by use of examples.

Figure 4:
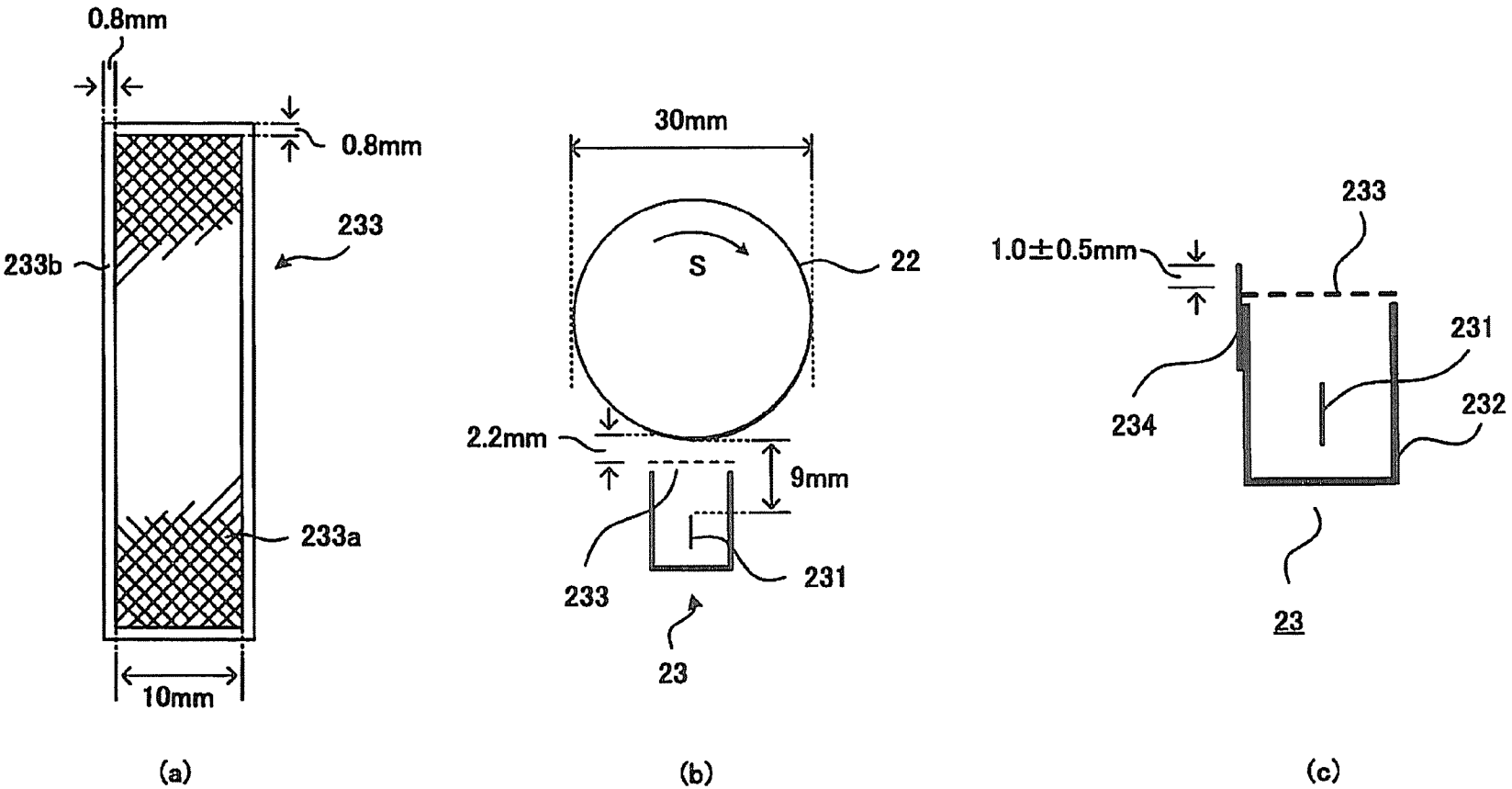
FIGS. 4A to 4C are views showing a photoconductive drum and the charging device in an embodiment.

As shown in FIGS. 4A to 4C, in the following evaluation, a photoconductive drum 22 of ϕ30 mm, a grid electrode 233 having an opening width of 10 mm and a peripheral part (233*b*) of 0.8 mm, a charging device 23 having a needle (sawtooth) electrode 231, and a shielding member 234 are used. Incidentally, the gap between the peripheral part 233*b* of the grid electrode 233 and the photoconductive drum 22 is 2.2 mm, and the gap between the photoconductive drum 22 and the needle (sawtooth) electrode 231 is 9 mm.

Protruding Length And Material of The Shielding Member

Protruding Length of The Shielding Member to Ozone

As the shielding member 234, sheet members made of ABS, denatured PPE, PET, polymethyl acrylate, PVDF, urethane and conductive PE are bonded to the side surface of a housing 232 at the exposure position side, so that the sheet members are protruded from the position where the grid electrode 233 is provided to the photoconductive drum side, and do not contact the photoconductive drum 22.

With respect to each of the shielding members, a high voltage of −800 μA of constant current control is applied to the needle (sawtooth) electrode 231, −500V is applied to the grid electrode 233 made of stainless steel and the housing 232, and the gap between the photoconductive drum 22 and the shielding member 234 is measured in which ozone does not stay in the charging device 23. In order to prevent the ozone from staying in the charging device 23, it is necessary that the gap between the photoconductive drum 22 and the shielding member 234 is 0.5 mm or more in any of the shielding members.

Figure 5:
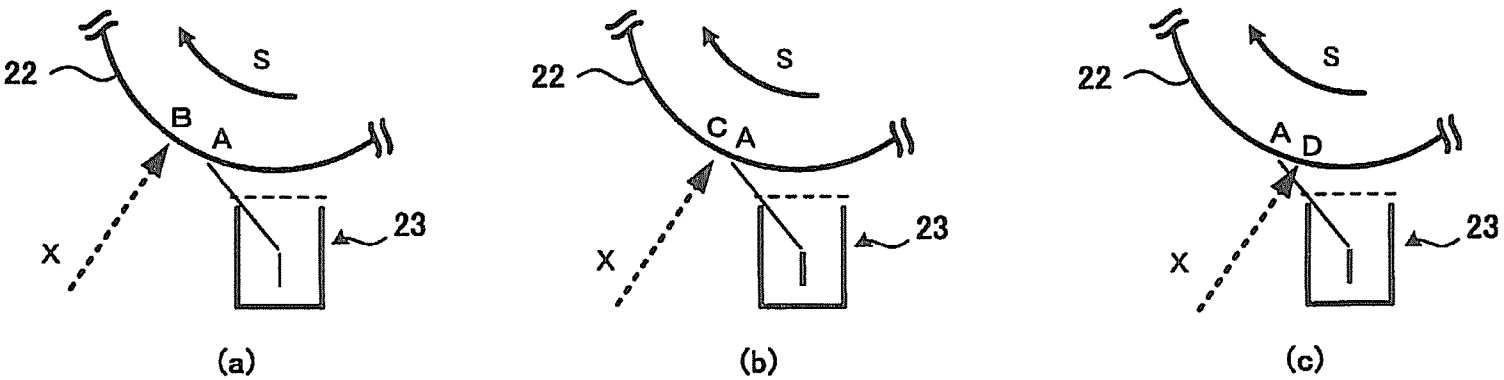
FIGS. 5A to 5C are views showing an evaluation method of the leakage of electrification charge.

Protruding Length And Material of The Shielding Member to Electrification Charge As shown in FIGS. 5A to 5C, in a state where the shielding member 234 is not attached, a point where an extension of a straight line connecting the tip end of the needle (sawtooth) electrode 231 and the opening end of the grid electrode 233 at the exposure side intercepts the photoconductive drum 22 is denoted by A. The exposure position on the photoconductive drum 22 is adjusted to three points, that is, point B spaced from the point A by 2 mm, point C spaced from the point A by 0.5 mm, and point D spaced from the point A by 0.5 mm in the opposite direction to the former points. As the shielding member 234, ABS (relative dielectric constant 2.5), denatured PPE (relative dielectric constant 2.6), PET (relative dielectric constant 3), polymethyl acrylate (relative dielectric constant 4), PVDF (relative dielectric constant 6), urethane (relative dielectric constant 7), and conductive PE (relative dielectric constant 30) are used and the protruding length is evaluated.

Figure 7:
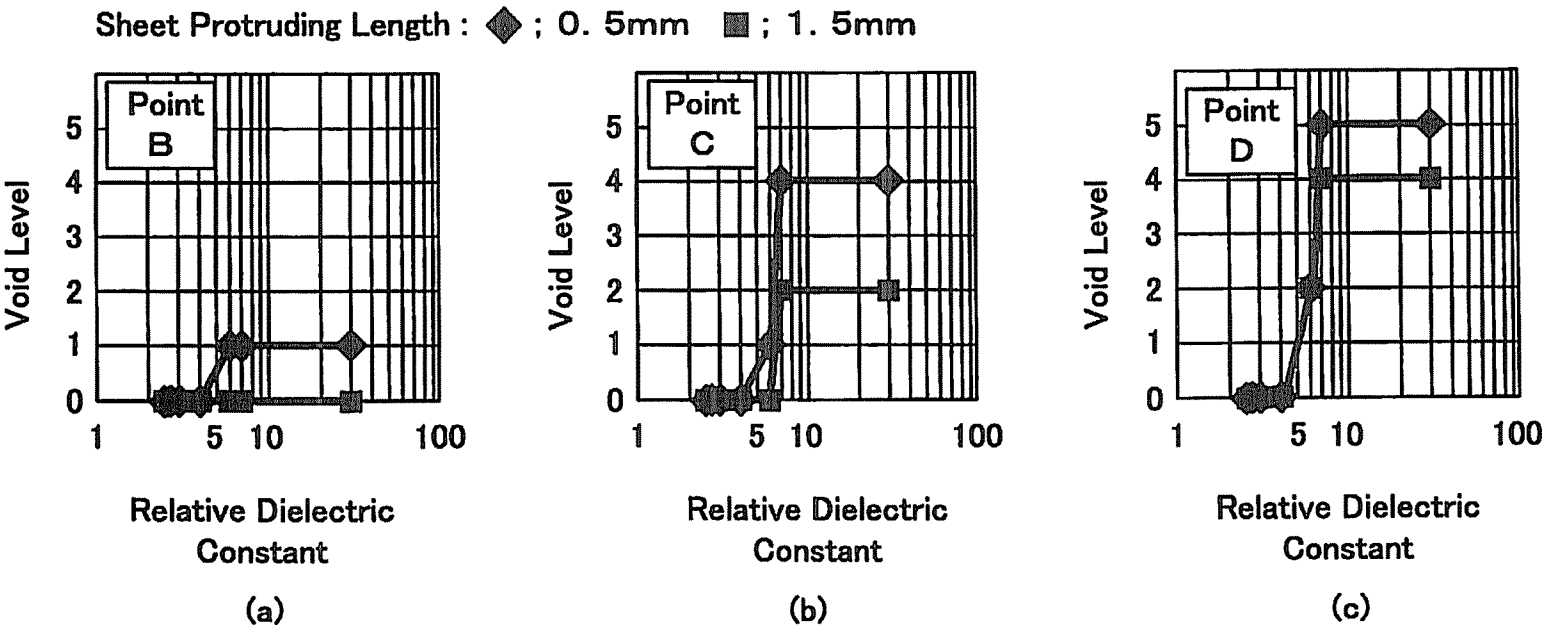
FIGS. 7A to 7C are graphs showing a relation between the protruding length of a shielding member and the relative dielectric constant of the shielding member.

As the protruding length, from the viewpoint of mass productivity, a tolerance range of the protruding length from the grid electrode 233 is required to be 1.0 mm, the protruding length of the shielding member 234 from the grid electrode 233 is preferably 1.0±0.5 mm, and it is desirable that the leakage of the electrification charge is prevented at the lower limit protruding length of 0.5 mm. Accordingly, at the lower limit of 0.5 mm (gap between the photoconductive drum 22 and the shielding member 234; 1.7 mm) of the protruding length from the grid electrode 233 and the upper limit of 1.5 mm (gap between the photoconductive drum 22 and the shielding member 234; 0.7 mm), a void in an edge part of a halftone image caused by the leakage of electrification charge is divided into levels of six stages described below and is evaluated. FIGS. 7A to 7C show evaluation results.

Figure 6:
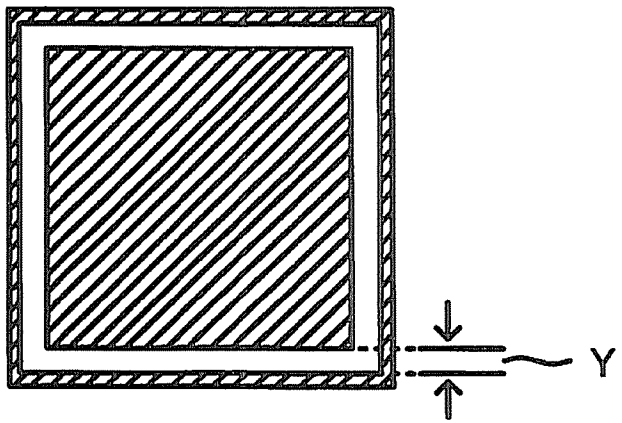
FIG. 6 is a view showing an evaluation method of a void level.

A black halftone patch in which the image density of the center part is adjusted within a range of 0.30±0.03 is printed, the width of a void having the largest range among the four sides is measured, and the level is given (FIG. 6).

level 0; $Y<0.1$ mm
level 1; $0.1 \leqq Y<0.2$ mm
level 2; $0.2 \leqq Y<0.4$ mm
level 3; $0.4 \leqq Y<0.7$ mm
level 4; $0.7 \leqq Y<1.0$ mm
level 5; $1.0<Y$ As shown in FIGS. 7A to 7C, it is understood that when a material having a relative dielectric constant of 5 or less is used, the void level is excellent in any case. On the other hand, it is understood that when a material having a relative dielectric constant of 6 or more is used, there is a tendency that the void level becomes worse in order of the exposure positions B, C and D, and when the sheet protruding length is short (0.5 mm), the level becomes even worse.

As described above, it is understood that the void level depends on the dielectric constant of the sheet material. It appears that a material having a low dielectric constant has high capacity to hold electric charge on the surface, the held electric charge electrostatically shields the electrification charge in the charging device, and prevents it from leaking to the exposure side. When the sheet protruding length is the upper limit of 1.5 mm, although it can be said that the physical shielding effect becomes high, the electrostatic shielding effect is the same as that at the lower limit of 0.5 mm.

As described above, according to the embodiment, the charging device and the exposure position can be set to be close to each other, which contributes to miniaturization of the image forming apparatus. Especially, the effect is high for a full-color image forming apparatus in which plural process units are provided.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions the accompanying claims and their equivalents are intended to cover such forms or modifications as would fall within the scope and spirit of the inventions.

What is claimed is:

1. An image forming apparatus comprising:
an image carrier whose surface is moved in a specific direction;
a charging device to charge the image carrier;
an exposure device to form an electrostatic latent image by exposing a surface of the charged image carrier in accordance with an image signal;
a developing device to supply a developer to the surface of the image carrier on which the electrostatic latent image is formed;
a transfer device to transfer a developer image formed on the surface of the image carrier onto an image forming medium; and
a dielectric member that has a dielectric constant of 5 or less and is disposed near the image carrier and between the charging device and the exposure device,
the charging device, the exposure device, the developing device and the transfer device being sequentially arranged around the image carrier along the movement direction of the surface of the image carrier.

2. The apparatus of claim 1, wherein the charging device includes a charge generation part to perform corona discharge, a conductive housing that covers the charge generation part and is made of a conductive member having an opening for discharge, and a grid electrode attached to the opening.

3. The apparatus of claim 2, wherein the dielectric member is fixed to a side surface of the housing at a side of the exposure device, and a tip part of the dielectric member protrudes to the image carrier from the grid electrode at a position between the charging device and the image carrier surface part exposed by the exposure device.

4. The apparatus of claim 3, wherein a protruding length of the dielectric member from a position where the grid electrode is provided is within a range of 0.5 to 1.5 mm.

5. The apparatus of claim 3, wherein a gap between the dielectric member and the image carrier is 0.5 mm or more.

6. The apparatus of claim 2, wherein the charge generation part includes protrusions that are arranged.

7. The apparatus of claim 2, wherein the charge generation part includes a wire that is stretched.

8. The apparatus of claim 2, wherein the grid electrode includes a mesh-shaped opening.

9. The apparatus of claim 1, wherein the dielectric member is made of denatured PPE.

10. The apparatus of claim 1, wherein the dielectric member is made of ABS.

11. The apparatus of claim 1, wherein the dielectric member is made of polymethyl acrylate.

12. A charging device used for an image forming apparatus including an image carrier whose surface is moved in a specific direction, the charging device to charge the image carrier, an exposure device to form an electrostatic latent image by exposing a surface of the charged image carrier in accordance with an image signal, a developing device to supply a developer to the surface of the image carrier on which the electrostatic latent image is formed, and a transfer device to transfer a developer image formed on the surface of the image carrier onto an image forming medium, wherein the charging device, the exposure device, the developing device and the transfer device are sequentially arranged around the image carrier along the movement direction of the surface of the image carrier, and the charging device comprises:

a charge generation part to perform corona discharge;

a conductive housing that covers the charge generation part and has an opening for discharge;

a grid electrode attached to the opening; and a dielectric member attached to a side surface of the housing at a side of the exposure device, whose tip part protrudes to the image carrier from the grid electrode and is close to the image carrier, and whose dielectric constant is 5.0 or less.

13. The charging device of claim 12, wherein a protruding length of the dielectric member from a position where the grid electrode is provided is within a range of 0.5 to 1.5 mm.

14. The charging device of claim 12, wherein the charge generation part includes protrusions that are arranged.

15. The charging device of claim 12, wherein the charge generation part includes a wire that is stretched.

16. The charging device of claim 12, wherein the grid electrode includes a mesh shaped opening.

17. The charging device of claim 12, wherein the dielectric member is made of denatured PPE.

18. The charging device of claim 12, wherein the dielectric member is made of polymethyl acrylate.

19. The charging device of claim 12, wherein the dielectric member is made of ABS.

* * * * *